United States Patent [19]

Richardson

[11] Patent Number: 4,971,031

[45] Date of Patent: Nov. 20, 1990

[54] DUAL BURNER FIREPLACE

[75] Inventor: Stephen F. Richardson, Randolph Center, Vt.

[73] Assignee: Robert H. Peterson Company, City of Industry, Calif.

[21] Appl. No.: 504,391

[22] Filed: Apr. 4, 1990

[51] Int. Cl.[5] ..... F23C 3/00

[52] U.S. Cl. ..... 126/512; 126/92 AC

[58] Field of Search ..... 126/512, 92 R, 92 AC; 431/125

[56] References Cited

U.S. PATENT DOCUMENTS

| | | | |
|---|---|---|---|
| Re. 25,987 | 3/1966 | Dupler . | |
| D. 224,535 | 8/1972 | Whitehead . | |
| 3,042,109 | 7/1962 | Peterson . | |
| 3,227,149 | 1/1966 | Clark . | |
| 3,362,395 | 1/1968 | Peterson . | |
| 3,382,861 | 5/1968 | Peterson . | |
| 3,385,651 | 5/1968 | Rasmussen et al. . | |
| 3,543,741 | 12/1970 | Whitehead . | |
| 3,582,250 | 6/1971 | Chatfield . | |
| 3,671,175 | 6/1972 | Campbell . | |
| 3,696,801 | 10/1972 | Whitehead . | |
| 3,805,762 | 4/1974 | Nelson . | |
| 3,905,351 | 9/1975 | Hatfield et al. . | |
| 4,000,732 | 1/1977 | White . | |
| 4,061,133 | 12/1977 | Swain . | |
| 4,602,609 | 7/1986 | Wright | 126/512 |
| 4,828,485 | 5/1989 | Jankowski . | |
| 4,875,464 | 10/1989 | Shimek et al. . | |
| 4,883,043 | 11/1989 | Thow et al. . | |

*Primary Examiner*—Carroll B. Dority

*Attorney, Agent, or Firm*—William W. Haefliger

[57] ABSTRACT

A dual burner fireplace comprising a grate to carry log means at forward and rearward locations; and front and rear elongated burners carried by the grate; the front burner having gas porting to produce flames rising to relatively lower levels at or proximate the forward locations; and the rear burner having combustible gas porting to produce flames rising to relatively higher levels at or proximate the rearward location.

12 Claims, 3 Drawing Sheets

DUAL BURNER FIREPLACE

BACKGROUND OF THE INVENTION

This invention relates generally to fireplace or hearth requirement, and more particularly to the enhanced creation of a natural log fire using artificial logs and gas fed combustion.

There is continuing need for fireplace equipment which, when assembled, enables creation of gas fed combustion to produce flames that play on artificial logs on grates. The need extends to creation of as natural a look as possible, when viewed from the front of the hearth. In this regard, the effect should be such as to support flame creation at different levels in close association with the artificial logs. At the same time, simplicity, ruggedness and high reliability of the equipment are required.

SUMMARY OF THE INVENTION

It is a major object of the invention to provide apparatus meeting the above needs, and which is easy to assemble and operate. Basically, the invention is embodied in a dual burner fireplace that includes:

(a) a grate to carry log means at forward and rearward locations, and (b) front and rear elongated burners carried by the grate, (c) the front burner having gas porting to produce flames rising to relatively lower levels at or proximate the forward location, and (d) the rear burner having combustible gas porting to produce flames rising to relatively higher levels at or proximate the rearward location.

As will be seen, a gas supply duct is typically connected with the front and rear burners, intermediate opposite ends of each burner, thereby to supply even gas distribution to the rear burner at a higher elevation, and to the front burner at a lower elevation; and wherein certain of the rear burner ports define elongated slots to release combustible gas productive of rising sheets of flame.

It is a further object of the invention to integrate the front and rear burners, and supply duct, in an H-shaped, rigid assembly to be accurately positioned relative to the grate and to also accurately position logs relative to such burners and relative to the grate. To this end, support means may be received and positioned on the grate to support the rear burner above the grate, with the front burner positioned generally below the grate, together with log positioning means on the support means to position the log means relative to the burner forwardly and rearwardly.

A further object is to provide a gas flow restriction in a portion of the duct leading to the front burner, whereby less gas is delivered to the front burner porting then to the rear burner porting, to create a differential flame height condition.

These and other objects and advantages of the invention, as well as the details of an illustrative embodiment, will be more fully understood from the following specification and drawings, in which:

DRAWING DESCRIPTION

DETAILED DESCRIPTION

Figure 1:
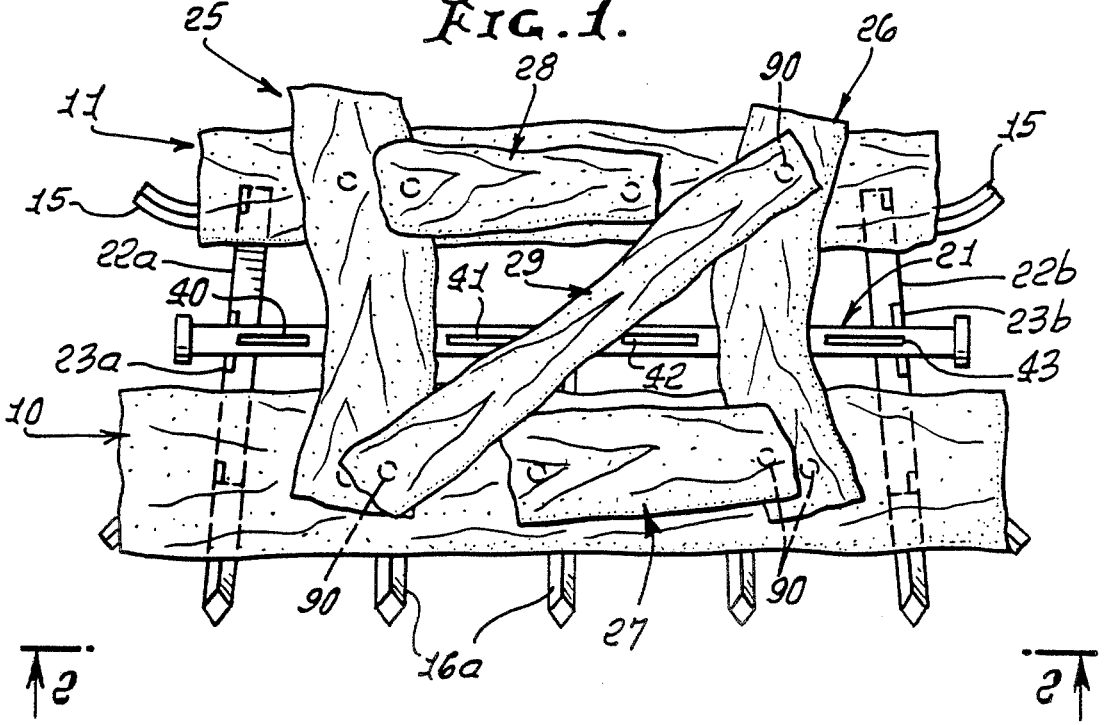
FIG. 1 is a top plan view of a fireplace incorporating the invention.

In the drawings, front and rear logs 10 and 11 are carried on a grate 12 at forward and rearward locations, as shown. The grate includes front and rear transversely extending metallic members 13 and 14. The latter are supported on legs 15, and in turn support forwardly and rearwardly extending metallic bars 16, which are transversely spaced apart and have upwardly inclined ends or terminals **16*a*. Either or both logs 10 and 11 may consist of non-combustible material, such as refractory, ceramic or other fire-resisting material, the object being that a natural, log-burning hearth will be simulated or created, when viewed from the front, as in FIG. 2**. One or more natural logs may be used in the fireplace as well.

Figure 2:
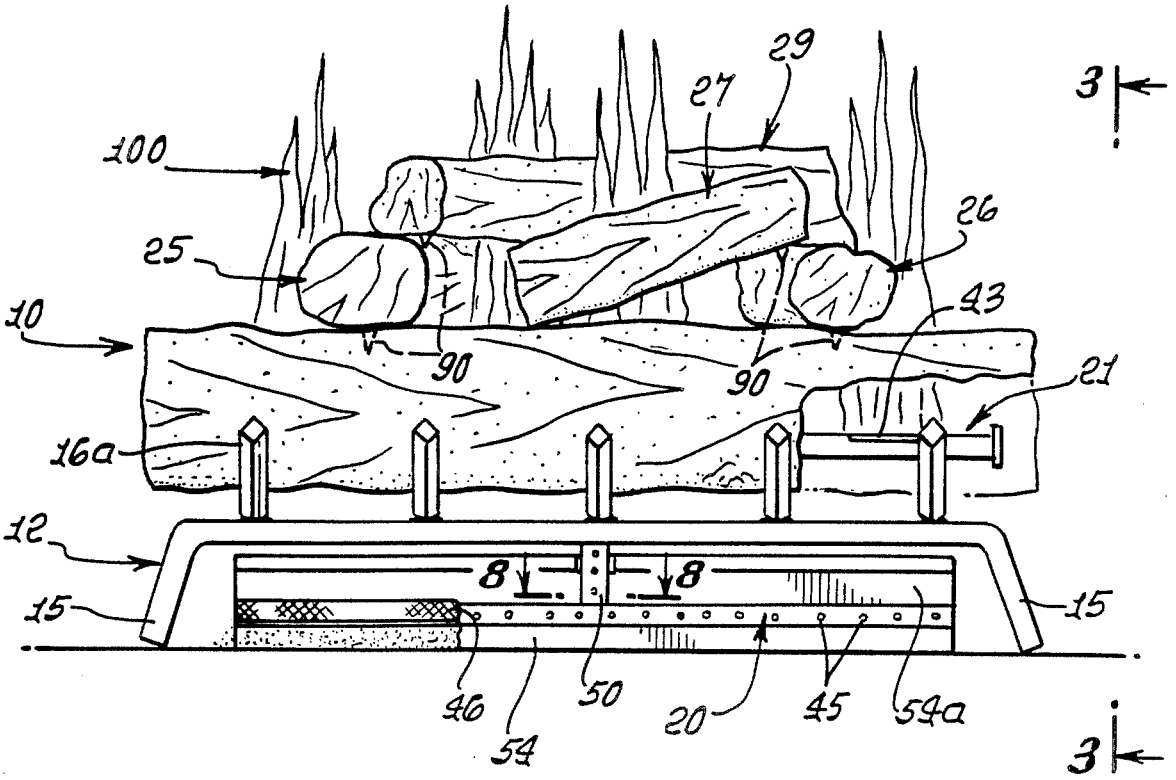
FIG. 2 is a frontal view taken on lines 2—2 of FIG. 1.
Figure 3:
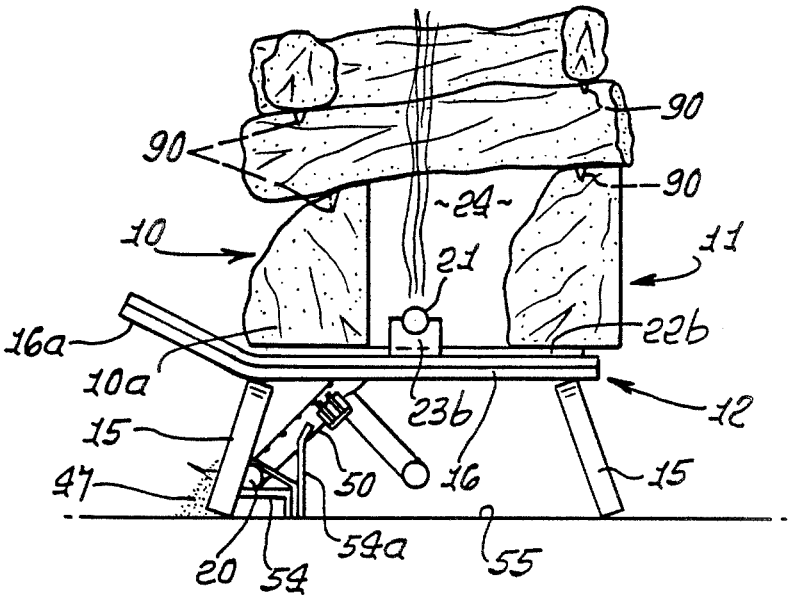
FIG. 3 is a side elevation taken on lines 3—3 of FIG. 2.

The fireplace also includes front and rear, transversely elongated gas burners 20 and 21, at least one of which is carried by the grate. For example, rear burner 21 has opposite end portions **21*a* and 21*b* carried by bars 16*b* and 16*c*, via forwardly elongated supports 22*a* and 22*b* interfitting the bars, and via tabs or uprights 23*a* and 23*b* on those supports. Rear burner 21 is located generally in the space 24 between the logs 10 and 11, as seen in FIG. 3, whereby flames rising from the rear burner pass upwardly between 10 and 11, and between additional logs 25–29 resting on logs 10 and 11, as for example is seen in FIGS. 1 and 2**.

Figure 6:
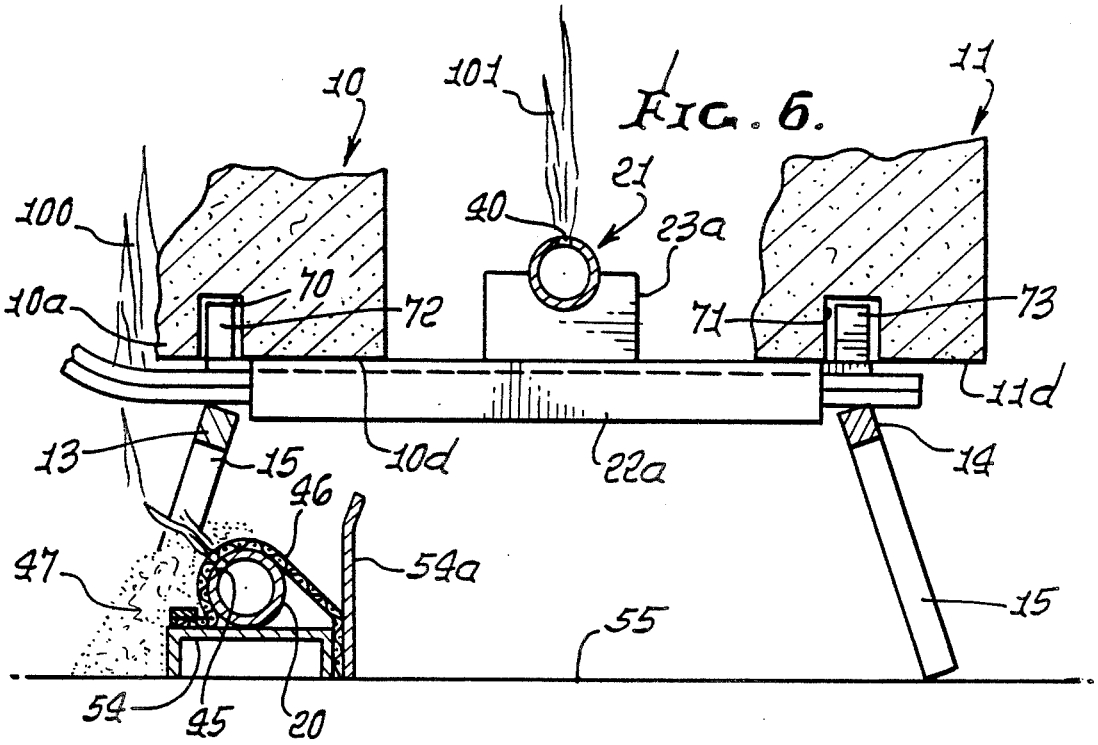
FIG. 6 is a section taken in elevation on lines 6—6 of FIG. 4.

The forward burner 20 extends at a lower level, beneath the levels of bars 16 and of burner 21, and generally beneath the front portion **10*a* of log 10, as seen in FIG. 6. Flames rising from ports (drilled openings) in burner tube 20 rise at, and play over, the front surfaces of logs 10, 25, 26, 27, and 29. Flames 100 from burner 20 rise to lower levels than flames 101 from burner 21**.

Figure 4:
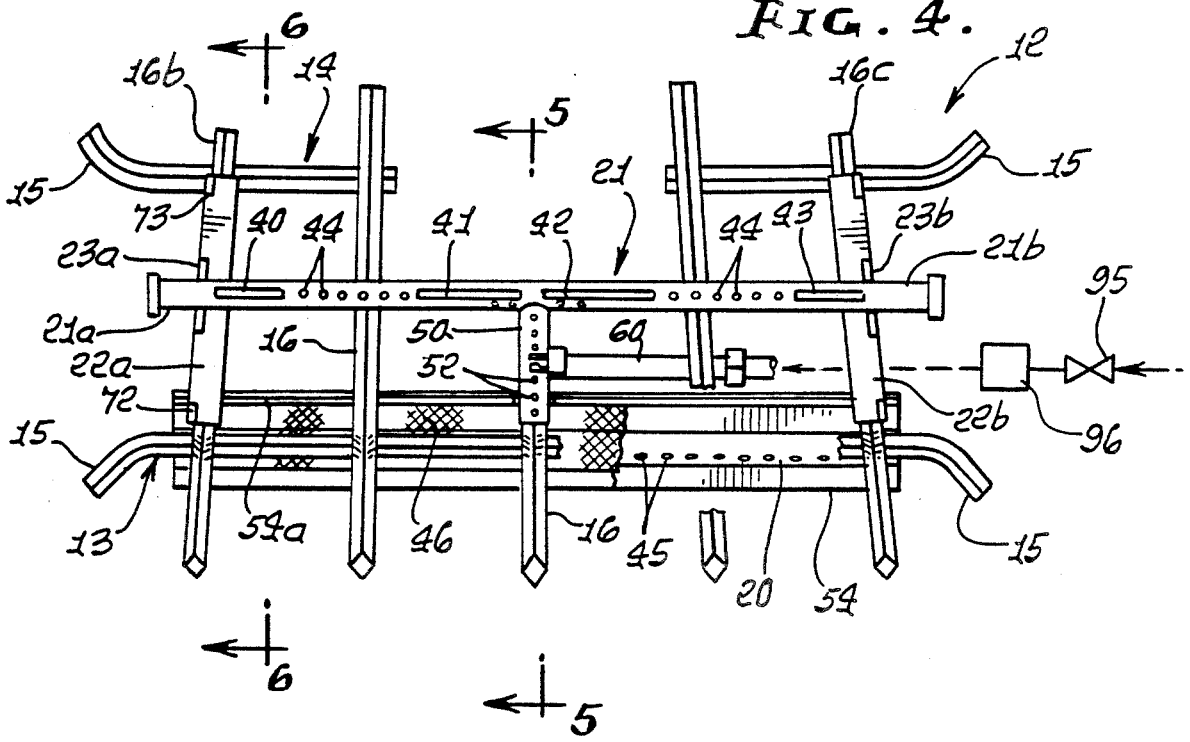
FIG. 4 is a top plan view of a grate incorporating the invention.

Certain of the upper rear burner ports define elongated slots, as at 40–43, to release combustible gas production of rising sheets of flames. Slots 40–43 are transversely spaced apart, and upwardly directed, as seen in FIG. 4, for example. Small, circular ports 44 are spaced apart between the slots, and open forwardly, to release gas producing, rising, localized flames, between the sheets of flames, giving a realistic wooden log-burning appearance. Also, these ports provide ignition carry-over from slot to slot without causing ignition flame-up impingement on the logs.

Figure 5:
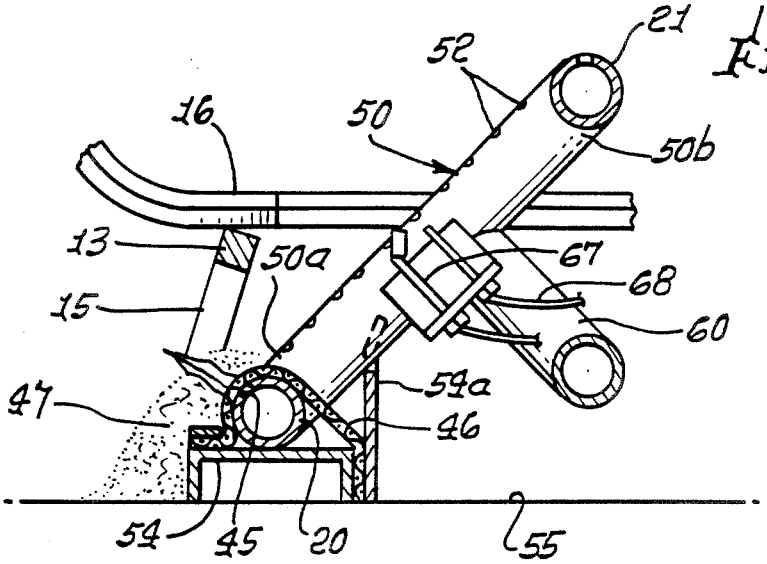
FIG. 5 is a section taken in elevation on lines 5—5 of FIG. 4.

The front burner 20 also has transversely spaced apart, small, circular ports 45 for releasing combustible gas producing, rising, localized flames. A screen 46 may be placed over the front burner, as seen in FIGS. 5 and 6, and particles 47 filled over the screen and at the front thereof (in front of ports 45) to be heated and to produce a glowing ember effect. One such product is sold under the name "Ember Glow" by Robert H. Peterson Company, City of Industry, Calif..

Also provided is a gas supply duct 50 connected with the burners 20 and 21, intermediate their opposite sides. Duct 50 may be rigidly connected at its opposite ends 50*a* and 50*b*, with the burners, to form a tilted, H-shaped structure or configuration. Note that duct 50 is inclined forwardly and downwardly. Ports 52 in duct 50 release combustible gas to produce more, i.e., enhanced, flames centrally of the fireplace. Also, ports 52 provide ignition carry-over to ensure ignition from the pilot flame to the upper and lower burners. A support 54 is shown in FIGS. 5 and 6 under the burner 20 and screen 46 to engage the hearth floor surface 55 to provide additional support for the H-shaped burner structure, and to position it as shown. Another associated support 54*a* is provided for duct 50, and also limits rearward filling of the embers 47.

Figure 8:
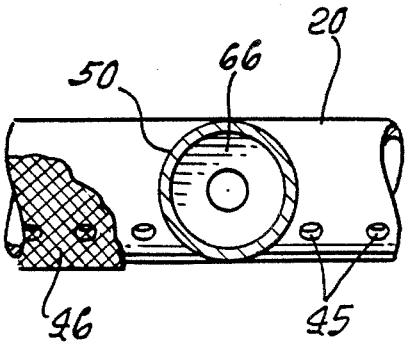
FIG. 8 is a fragmentary plan view taken on lines 8—8 of FIG. 2.

Combustible gas is fed via pipe 60 to the duct 50 for distribution to the burners. A restriction in a portion of duct 50 leading to the front burner serves to reduce somewhat the rate of gas distribution to that burner, whereby the rate of gas flow through its ports is less than the rate of gas flow through the ports of rear burner 21. Thus, flames produced by the front burner rise to lower levels than flames from the rear burner, giving further enhanced, natural hearth-burning effect. To this end, and as seen in FIG. 8, an orifice plate 66 may be located in duct 50 forward of the junction with pipe 60. A pilot light gas pipe 67 extends to the duct 50 (see FIG. 5) as does a thermocouple 68 that provides pilot ignition.

Figure 7:
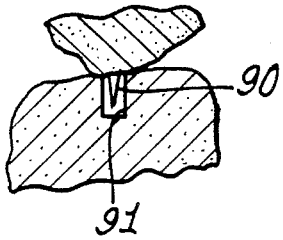
FIG. 7 is a fragmentary view showing interfit of two artificial logs.

Further, and as seen in FIG. 6, logs 10 and 11 may have recesses 70 and 71 in their flat undersides 10*d* and 11*d* for reception of upright locating tabs 72 and 73. The latter are carried by the supports 22*a* and 22*b* for accurately locating the logs 10 and 11 relative to the front and rear burner 20 and 21, for desirable flame play on the log set, as shown. Lower logs 10 and 11 in turn locate the upper logs 25 and 26 for this same purpose. See pins 90 integral with the upper logs received in recesses 91 in the lower logs, FIG. 7 showing this in detail. Also, log 29 has pins 90 at its opposite lower rear fitting in recesses 91 in logs 25 and 26; log 28 has such lower pins received in upper recesses 91 in logs 25 and 28; and log 2 has lower pins 90 received in upper recesses in logs 26 and 27. Logs 25, 26, and 29 cross over burner 11, as seen in FIG. 1. The grate members that support sections 22*a* and 22*b* diverge forwardly, as do those sections, to accurately locate the sections on the grate, forwardly and rearwardly.

A gas shut-off valve may be provided at 95, and suitable gas/air mixing means may be provided at 96 (to provide a combustible mixture).

I claim:

1. In a dual burner fireplace, the combination comprising (a) a grate to carry log means at forward and rearward locations, and (b) front and rear elongated burners carried by the grate, (c) the front burner having gas porting to produce flames rising to relatively lower levels at or proximate the forward locations, and (d) the rear burner having combustible gas porting to produce flames rising to relatively higher levels at or proximate the rearward location, (e) and including support means received and positioned on the grate to support the rear burner above the grate, with the front burner positioned generally below the grate, and log positioning means on the support means to locate the log means relative to said burners, relatively forwardly and rearwardly.

2. The combination of claim 1 wherein the grate includes spaced grate bars supporting spaced sections of the support means, said bars diverging forwardly, and said support means sections diverging forwardly.

3. In a dual burner fireplace, the combination comprising (a) a grate to carry log means at forward and rearward locations, and (b) front and rear elongated burners carried by the grate, (c) the front burner having gas porting to produce flames rising to relatively lower levels at or proximate the forward location, and (d) the rear burner having combustible gas porting to produce flames rising to relatively higher levels at or proximate the rearward location.

(e) and including a gas supply duct connected with the front and rear burners, intermediate opposite ends of each burner.

4. The combination of claim 3 wherein said burners extend in generally parallel relation, the front and rear burners extending at lower and higher elevations, respectively.

5. The combination of claim 4 wherein certain of said rear burner ports define elongated slots to release combustible gas productive of rising sheets of flame.

6. The combination of claim 3 wherein said gas supply duct also has combustible gas porting, the front and rear burners and said duct forming an H-shaped configuration.

7. The combination of claim 3 including a gas flow restriction in a portion of the duct leading to said front burner, whereby less gas is delivered to the front burner porting then to the rear burner porting.

8. The combination of claim 3 wherein the grate includes transversely spaced, elongated members, the rear burner carried by at least two of said members, the front burner carried by the rear burner via said supply duct.

9. The combination of claim 6 including support means received and positioned on the grate to support the rear burner above the grate, with the front burner positioned generally below the grate, and log positioning means on the support means to locate the log means relative to said burner, relatively forwardly and rearwardly.

10. The combination of claim 6 including a screen over the lower burner, and support means associated with the screen and lower burner for reception of particles which glow when heated.

11. The combination of claim 10 including means to support the upper burner on and above the grate, said duct inclined forwardly and downwardly to support intermediate extent of the lower burner below the grate.

12. In a dual burner fireplace, the combination comprising (a) a grate to carry log means at forward and rearward locations, and (b) front and rear elongated burners carried by the grate, (c) the front burner having gas porting to produce flames rising to relatively lower levels at or proximate the forward location, and (d) the rear burner having combustible gas porting to produce flames rising to relatively higher levels at or proximate the rearward location, (e) and including a protective screen extending over the front burner to intercept and space ember pieces from the front burner porting.

* * * * *